US006666262B1

(12) United States Patent
Parneix et al.

(10) Patent No.: US 6,666,262 B1
(45) Date of Patent: Dec. 23, 2003

(54) ARRANGEMENT FOR COOLING A FLOW-PASSAGE WALL SURROUNDING A FLOW PASSAGE, HAVING AT LEAST ONE RIB FEATURE

(75) Inventors: Sacha Parneix, Zürich (CH); Jens Von Wolfersdorf, Untersiggenthal (CH); Bernhard Weigand, Filderstadt-Sielmingen (DE)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/726,052

(22) Filed: Nov. 30, 2000

(30) Foreign Application Priority Data

Dec. 28, 1999 (DE) ..... 199 63 373

(51) Int. Cl.[7] ..... F28F 13/12; F24D 5/10

(52) U.S. Cl. ..... 165/109.1; 165/53; 165/168; 165/169

(58) Field of Search ..... 165/109.1, 53, 165/167, 168, 169; 261/112.2

(56) References Cited

U.S. PATENT DOCUMENTS

| | | | | |
|---|---|---|---|---|
| 3,249,155 A | | 5/1966 | Huet | |
| 3,741,285 A | * | 6/1973 | Kuethe | 165/181 |
| 3,840,070 A | * | 10/1974 | Becker et al. | 165/167 |
| 4,314,587 A | | 2/1982 | Hackett | |
| 4,470,453 A | * | 9/1984 | Laughlin et al. | 165/167 |
| 4,514,144 A | * | 4/1985 | Lee | 416/96 R |
| 4,775,296 A | * | 10/1988 | Schwarzmann et al. | 416/97 R |
| 4,781,248 A | * | 11/1988 | Pfeiffer | 165/167 |
| 5,040,596 A | * | 8/1991 | Terasaki et al. | 165/166 |
| 5,052,889 A | * | 10/1991 | Abdel-Messeh | 416/97 R |
| 5,307,870 A | * | 5/1994 | Kamiya et al. | 165/173 |
| 5,353,867 A | * | 10/1994 | Jaspers | 165/168 |
| 5,372,187 A | | 12/1994 | Haushalter | |
| 5,469,914 A | * | 11/1995 | Davidson et al. | 165/166 |
| 5,695,321 A | * | 12/1997 | Kercher | 416/97 R |
| 5,806,584 A | * | 9/1998 | Thonon et al. | 165/167 |
| 5,845,399 A | * | 12/1998 | Dewar et al. | 165/166 |
| 5,979,548 A | | 11/1999 | Rhodes et al. | |
| 6,073,686 A | * | 6/2000 | Park et al. | 165/144 |
| 6,164,372 A | * | 12/2000 | Persson | 165/167 |

FOREIGN PATENT DOCUMENTS

| | | | | |
|---|---|---|---|---|
| DE | 848508 | | 9/1952 | |
| DE | 851958 | | 10/1952 | |
| DE | 3521914 | C2 | 1/1986 | |
| DE | 195 26 917 | A1 | 1/1997 | |
| EP | 000530721 | A * | 3/1993 | 165/168 |
| FR | 1300121 | | 12/1962 | |
| JP | A-9-72683 | | 3/1997 | |
| JP | A-10-211537 | | 8/1998 | |

OTHER PUBLICATIONS

Okada et al., Design and Heat transfer Characteristics of New Plate Heat Exchanger, Japanese Research, vol. 1, No. 1 (Jan.–Mar. 1972).*

* cited by examiner

*Primary Examiner*—Henry Bennett
*Assistant Examiner*—Tho V Duong
(74) *Attorney, Agent, or Firm*—Burns, Doane, Swecker & Mathis, L.L.P.

(57) ABSTRACT

An arrangement for cooling a flow-passage wall surrounding a flow passage is described, having at least one rib feature which induces flow vortices in a flow medium passing through the flow passage, is attached to that side of the flow-passage wall which faces the flow passage, and has a main longitudinal extent which is oriented at an angle of $\alpha \neq 0°$ to the direction of flow of the flow medium passing through the flow passage.

The invention is characterized in that the rib feature, along the main longitudinal extent, at least partly has rib-feature sections whose axes enclose an angle of $\beta \neq 0°$ with the main longitudinal extent.

7 Claims, 4 Drawing Sheets

ARRANGEMENT FOR COOLING A FLOW-PASSAGE WALL SURROUNDING A FLOW PASSAGE, HAVING AT LEAST ONE RIB FEATURE

This application claims priority under 35 U.S.C. §§ 119 and/or 365 to Appln. No. 199 63 373.8 filed in Germany on Dec. 28, 1999; the entire content of which is hereby incorporated by reference.

FIELD OF THE INVENTION

The invention relates to an arrangement for cooling a flow-passage wall surrounding a flow passage.

BACKGROUND OF THE INVENTION

The increase in power of gas-turbine plants and the desire for higher efficiencies is closely linked with the demand for higher process temperatures, which occur due to the combustion of a fuel/air mixture inside the combustion chamber. However, the desire for higher process temperatures, which can be entirely fulfilled with modern combustion techniques, is in turn subject to material limits on account of the plant components which can only be thermally loaded to a limited degree and are directly exposed to the hot gases produced by the combustion inside the combustion chamber. In order to increase the process temperatures on the one hand, and thus increase the thermodynamic efficiency of a gas-turbine plant, but so that they nonetheless lie below the thermal melting-point level of the respective materials from which the individual gas-turbine plant components, such as, for example, turbine-blade bodies, combustion-chamber walls, etc., are made, those plant components subjected to high thermal loading are cooled in a manner known per se by means of cooling-passage systems of different design. Cooling passages, through which, compared with the temperature of the hot gases, relatively cold air is fed, are typically provided in the interior of turbine blades or along the combustion-chamber walls. For example, by the cooling-passage systems arranged downstream of the compressor stages, some of the compressed air is diverted from the air compressor and fed into the cooling passages.

In addition, in order to improve the cooling effect inside the cooling passages, it is known to attach rib features to the inner-wall sides of the cooling passages, which rib features are raised above the inner wall and permit a decisive improvement in the heat exchange between the hot cooling-passage wall and the cooling-air flow. The idea underlying the provision of cooling ribs is to form vortices close to the cooling-passage wall, by means of which vortices the cooling-air mass flow which comes in thermal contact with the cooling-passage inner wall can be increased decisively. Thus so-called secondary vortices form within the cooling-air flow, which is directed axially through the cooling passage, and these secondary vortices have vortex-flow components which are directed perpendicularly to the cooling-passage walls. The forming of such secondary vortices is illustrated in FIG. 2, in which a perspective cross section through a cooling passage 1 known per se is shown. The cooling passage 1 shown in the exemplary embodiment according to FIG. 2 has a square cross section and is therefore surrounded by four equally long cooling-passage walls. In this case, two opposite cooling-passage walls 2, 3 are each provided with rib features 4 arranged one behind the other in the longitudinal direction of the cooling passage. The rib features 4, which are of rectilinear design and have a rectangular cross section, preferably run at an angle to the longitudinal extent of the cooling passage 1 and enclose an angle a of about 45° with the longitudinal axis A of the cooling passage. If the cooling-air flow now passes axially through the cooling passage 1, a flow profile which provides two secondary vortices 5, 6 is formed by the rib features 4 in the cross section of flow of the coolant flow. The secondary vortices 5, 6 in turn lead to turbulent intermixing of the boundary layer directly over the cooling-passage inner wall, as a result of which improved cooling-air exchange takes place at the cooling-passage inner wall and a greater heat flow from the hot cooling-passage inner wall to the cooling-air flow is obtained. Based on this knowledge, many studies have been carried out which deal with the effect of the change in parameters determining the rib features on the heat-transfer efficiency, such as changes in the height of the rib features, the spacing of the rib features, the rib orientation relative to the longitudinal axis of the cooling passage, Reynolds and Prandtl number, cooling-passage aspect ratio, etc. However, investigations in this respect were restricted merely to rectilinear rib features.

SUMMARY OF THE INVENTION

The object of the invention is to develop an arrangement for cooling a flow-passage wall surrounding a flow passage, having at least one rib feature which induces flow vortices in a flow medium passing through the flow passage, is attached to that side of the flow-passage wall which faces the flow passage, and has a main longitudinal extent which is oriented at an angle of $\alpha \neq 0°$ to the direction of flow of the flow medium passing through the flow passage, in such a way that the cooling effect of the arrangement is to be considerably increased without a decisive increase in the production cost compared with conventional measures. The improvements are intended to make it possible to improve the cooling capacity of the cooling-air flow passing through a flow passage, so that a further increase in output is made possible by increased process temperatures inside the gas-turbine plant.

According to the invention, an arrangement according to the preamble of claim 1 is developed in such a way that the rib feature, along the main longitudinal extent, at least partly has rib-feature sections whose axes enclose an angle of $\beta \neq 0°$ with the main longitudinal extent.

The invention proceeds on the basis of the knowledge that rib features preferably running at an angle to the main flow inside a cooling passage generate the secondary vortices which are shown schematically in FIG. 2 and by means of which cool air is transported from the center of the cooling passage to the hot cooling-passage inner walls in order to effectively cool the latter. Unlike the hitherto rectilinear rib elements, the invention provides for the rib elements to be designed so as to be curved about their rib longitudinal axis in such a way that they assume, for example, a serpentine form, which can be constructed in many different ways. An especially preferred embodiment consists in the sinusoidal design of the rib elements, the main orientation of the rib element relative to the main flow being retained as in the known rectilinear rib elements, preferably 45° relative to the main flow direction.

A multiplicity of semicircular sections lined up directly next to one another are also suitable for forming geometrical configurations of the rib features according to the invention. For further, possible rib-feature designs, reference is made to the exemplary embodiments and the figures.

Two advantages in particular are associated with the design according to the invention of the rib features, namely a largely unchanged formation of secondary vortices, which leads to active intermixing of the boundary layer close to the inner-wall surface of the cooling passage. Furthermore, a larger surface of the rib features is created by the curved sections provided along the rib features, as a result of which the heat-transfer surface increases. Provided that the heat-transfer coefficient remains largely unchanged compared with the conventional, rectilinear rib elements due to the geometric modification of the rib features, which may be assumed, the heat exchange between the hot cooling-passage inner walls and the cooling air flowing through the cooling passage noticeably increases with the increased heat-transfer surface.

DESCRIPTION OF THE DRAWINGS

Preferred embodiments of the invention are described herein with reference to the accompanying drawings in which.

DETAILED DESCRIPTION OF THE INVENTION

Figure 1:
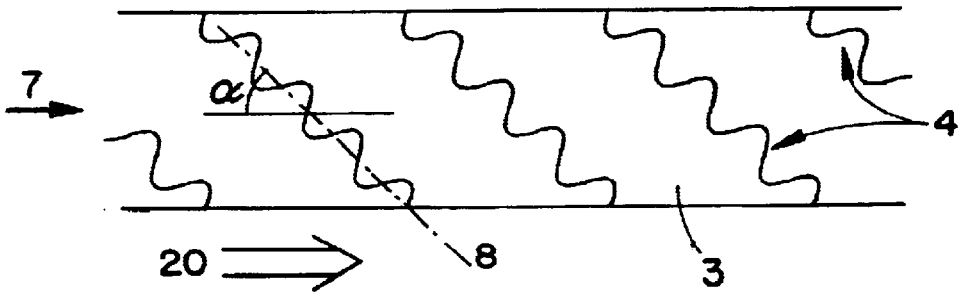
FIG. 1. is a schematic plan view of a cooling-passage inner wall having rib features according to the invention.
Figure 4A:
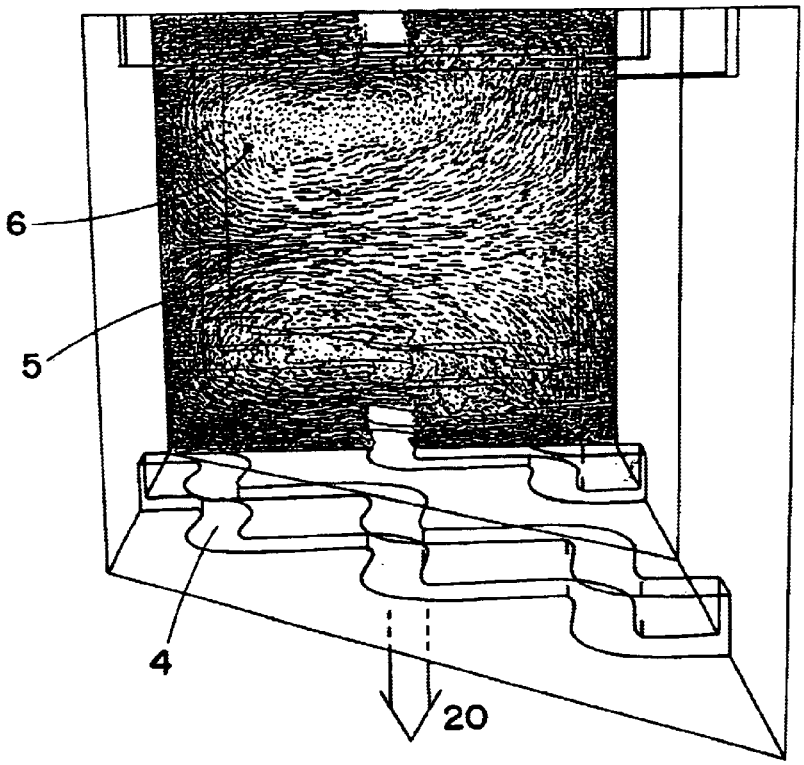
FIGS. 4*a–b* show perspective representations through cooling passages with rib features according to the invention.
Figure 4B:
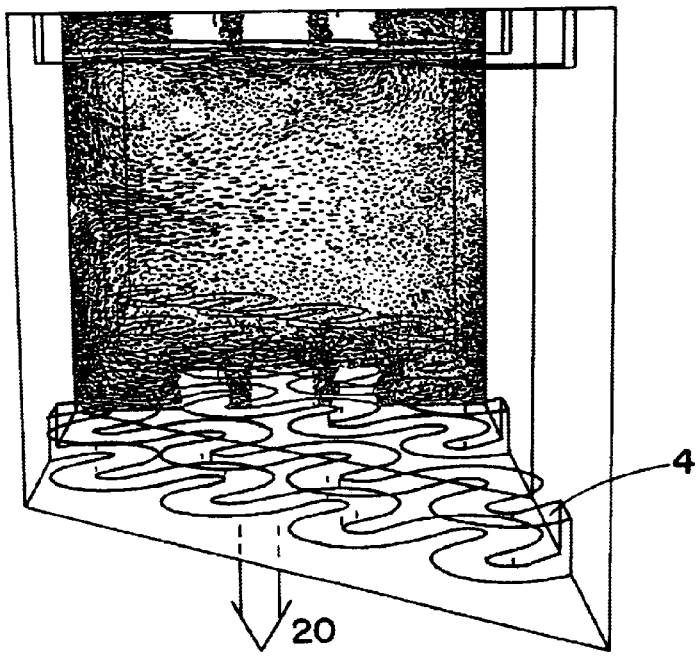
Figure 5A:
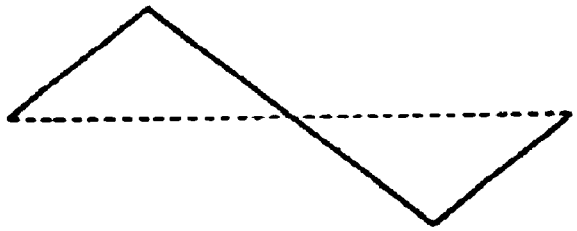
FIGS. 5*a–e* shows schematic representations for the course of further rib features in accordance with the invention.
Figure 5B:
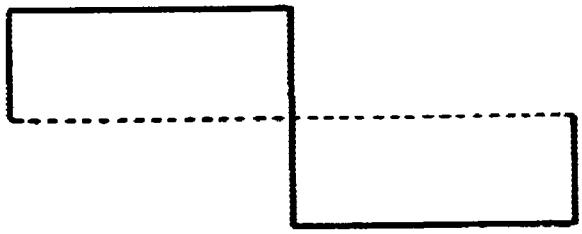
Figure 5C:
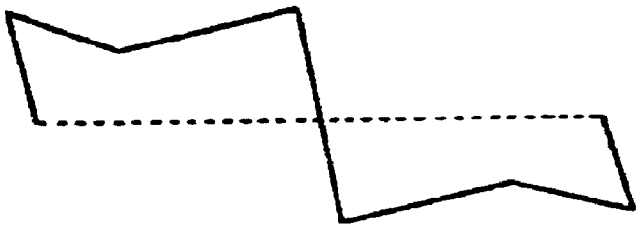
Figure 5D:
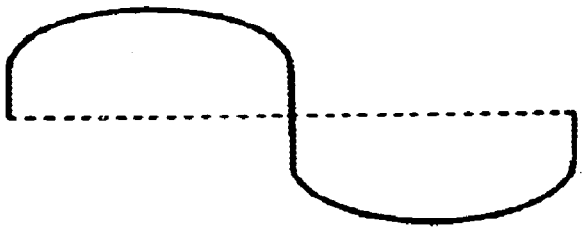
Figure 5E:
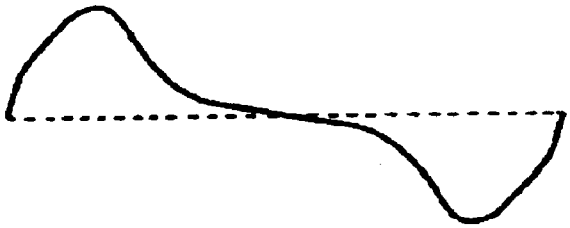

FIG. 1 shows a highly schematic plan view of a cooling-passage inner wall 3, on whose sides facing the cooling passage rib features 4 of curved design are provided. Hot gases 20, shown in FIGS. 1, 4*a* and 4*b*, represented by an arrow on the outside of wall 3, such as those produced by combustion, flow by the outside of the cooling passage wall, directly opposite from the rib features 4 on the inner wall 3. Just as in the known case according to FIG. 2, the rib features 4 are oriented at an angle to the main flow direction 7 and preferably enclose an angle of a $\alpha$=45° with said main flow direction 7. In the case shown, the rib features 4 are designed to be curved relative to their longitudinal axis 8, for example like a sinusoidal wave train.

Figure 3A:
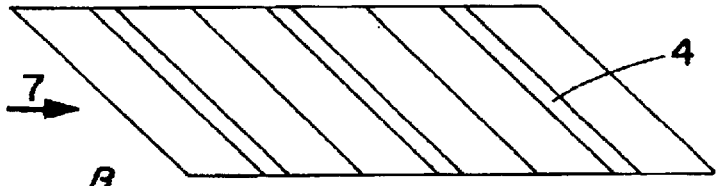
FIG. 3A PRIOR ART
FIGS. 3*a–d* show different embodiments of rib features.
Figure 3B:
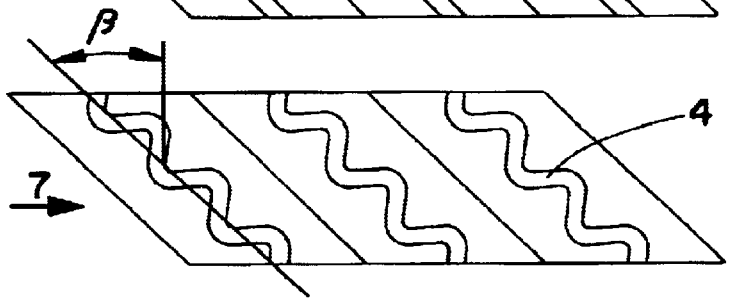
Figure 3C:
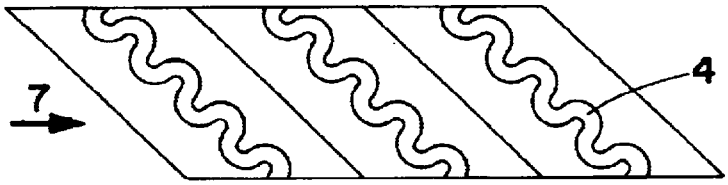
Figure 3D:
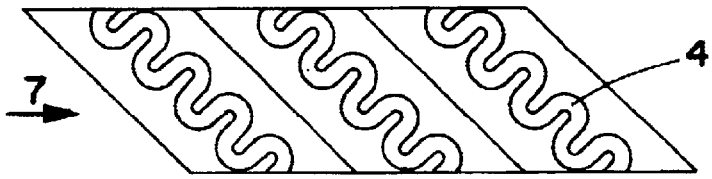

The surface of each individual rib feature is automatically enlarged by the wavy course of each individual rib feature, by which surface a heat exchange can take place from the hot passage inner wall 3 to the cooling air. The effect of the shape of the individual rib features on the total heat exchange inside the respective cooling passage is shown with reference to FIGS. 3*a–d*. It is assumed herein that the rib features 4 are oriented in a 45° geometrical configuration relative to the main flow direction 7. The rib features themselves have a rib height of about 10% of the cooling-passage height, a factor which corresponds to the hydraulic diameter of the cooling passage. Likewise, the ratio between the spacing of two adjacent rib features to their height is 10. The different rib-feature profiles shown below in FIGS. 3*a–d* are now to be compared with one another in terms of their heat-transfer properties. Shown in FIG. 3*a* is the conventional rib-feature course which is often used in cooling passages in a known manner. FIG. 3*b* shows rib features of sinusoidal design, FIG. 3*c* represents rib features which are composed of semicircular segments, and FIG. 3*d* shows rib features which are composed of semicircular segments and rib-feature segments connecting said semicircular segments in a rectilinear manner. All the rib features shown in FIGS. 3*a–d* otherwise have the same rib heights and are each provided on two opposite cooling-passage walls, over which cooling air flows.

The following table shows the relationship between different geometrical configurations of the rib features of FIGS. 3*a–d* and the heat transfer taking place in the interior of the cooling passage. Thus column a represents the factor of the increase in rib surface compared with a rectilinear rib according to FIG. 3*a*. The center column b contains the percentage factor concerning the surface increase relative to the entire cooling passage, and the right-hand column c shows the percentage increase in the heat transfer compared with the rib features shown in FIG. 3*a*. The individual lines of the table are assigned to the exemplary embodiments of FIGS. 3*b*, 3*c* and 3*d*.

It is found that the heat transfer can be influenced in a decisive and positive manner by the surface of the rib elements being enlarged. Thus, in the case of the rib elements according to the design in FIG. 3*d*, it can be seen that there is a heat-transfer increase of 21.4%, compared with the rectilinear rib elements according to FIG. 3*a*. In principle, any desired further geometrical rib configurations which have a contour enlarging their surface may be designed.

Figure 2:
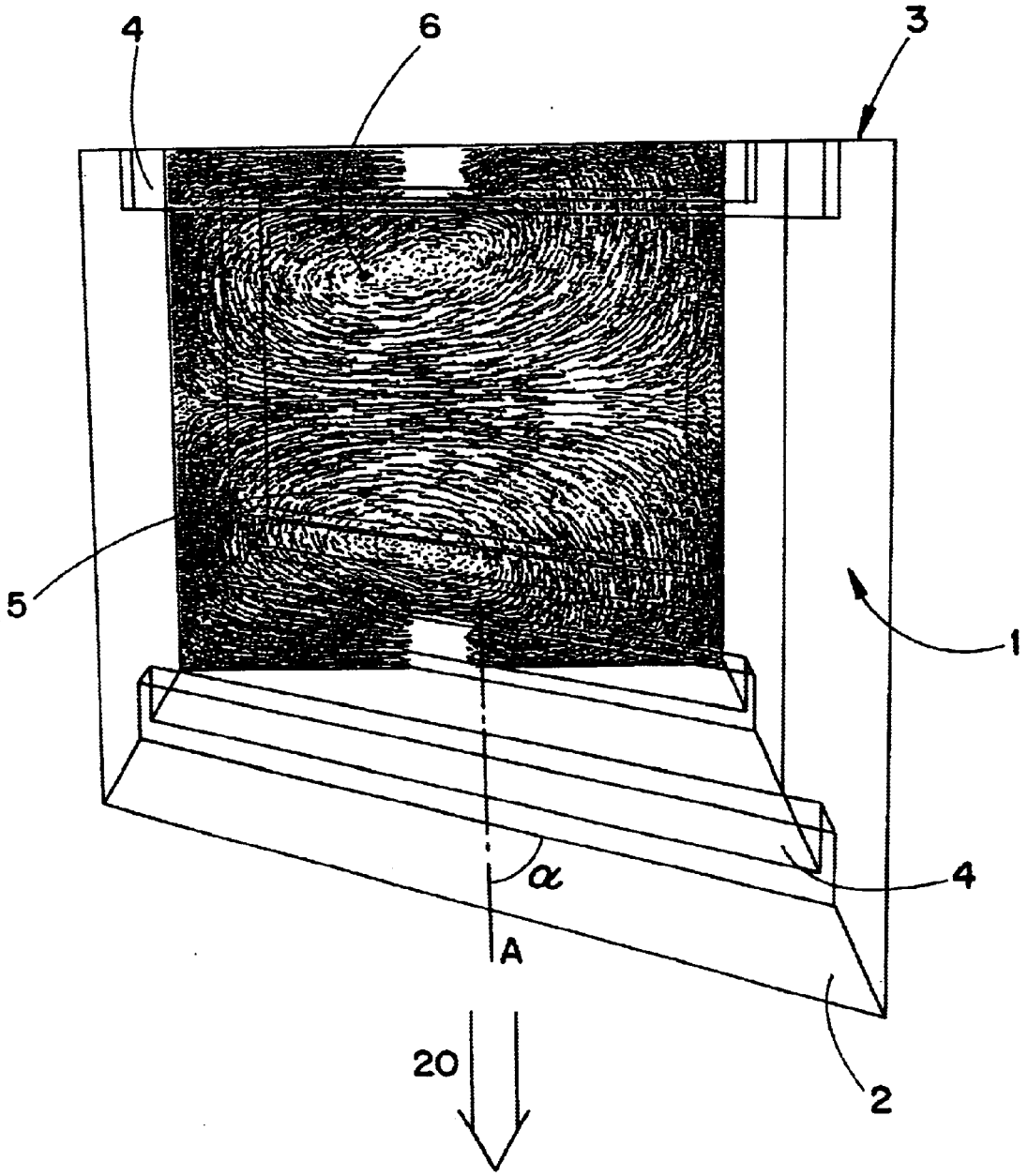
FIG. 2 PRIOR ART
FIG. 2 is a perspective representation through a cooling passage showing the flow profile in accordance with the prior art.

Perspective cross-sectional representations through a cooling passage of square design are shown in FIGS. 4*a* and 4*b*, just like the representation according to FIG. 2, but in FIGS. 4*a, b* the rib features 4 are designed to be curved according to the invention. Thus the rib features 4 in the exemplary embodiment according to FIG. 4*a* run sinusoidally, whereas the rib features according to FIG. 4*b* consist of semicircular segments which are lined up next to each other and are each connected to one another by rectilinear rib-feature sections.

When comparing the two rib forms according to FIGS. 4*a* and *b*, it can be said that, in the case of the sinusoidal ribs (FIG. 4*a*), secondary vortices 5, 6 are formed which have virtually the same vortex intensity as is the case, for example, in the cooling passage according to FIG. 2. However, it is found that the intensity of the formation of secondary vortices inside a cooling passage decreases in the case of rib features whose waviness and thus whose rib surface become larger. It can be seen from the cross-sectional profile according to FIG. 4*b* that the intensity of the secondary vortices is weaker than in the case according to FIG. 4*a*, yet there are also secondary vortices in FIG. 4*b* (see arrow) which result in an increased heat transfer between the cooling medium, air, and the hot chamber walls.

In addition to the geometrical configurations of the rib features shown, any further desired geometrical configurations of the rib features relative to their longitudinal axis are also conceivable, as can be seen from FIGS. 5*a–e*. In the individual representations, the course of the longitudinal axis of the rib features is depicted by a broken line. The solid line schematically represents the course of the rib feature. In addition to the rib features of curved design in FIGS. 3*b–d*, edged or angular geometrical configurations of the rib features, which result in a similar effect improving the heat transfer, are also conceivable according to FIGS. 5*a, b* and *c*. On the other hand, FIGS. 5*d* and *e* show curved or arched rib features relative to their longitudinal axis, depicted by a broken line.

What is claimed is:

1. An arrangement for cooling a flow-passage wall surrounding a flow passage in which a cooling medium flows, said flow passage wall being exposed on a side opposite from the side facing the flow passage to a second medium that heats the flow passage wall, such that heat is transferred from the flow passage wall to the cooling medium, the arrangement comprising: at least one rib feature on the side of the flow-passage wall which faces the flow passage and directly opposite from the side of the flow passage wall exposed to the second medium, the at least one rib feature has a main longitudinal extent which is oriented at an acute angle $\alpha$ to the direction of flow of the cooling medium passing through the flow passage, and wherein the rib-feature sections curve sinusoidally about the main longitudinal extent in a plane parallel to the flow passage wall, and wherein a plurality of the rib features are provided on each of two opposite flow-passage wall sides.

2. The arrangement as claimed in claim 1, wherein the flow passage has a rectangular or square cross section of flow and is defined by four flow-passage wall sides.

3. The arrangement as claimed in claim 2, wherein said plurality of rib-features is arranged one behind the other in the direction of flow in each case at a distance from one another.

4. The arrangement as claimed in claim 2, wherein at least one of the rib-features runs over an entire flow-passage wall side, which is defined on either side by two flow-passage wall sides.

5. The arrangement as claimed in claim 1, wherein the at least one rib feature consists entirely of rib-feature sections which have axes which enclose an angle of $\beta \neq 0°$ with the main longitudinal extent.

6. The arrangement as claimed in claim 1, wherein $\alpha$ is about 45°.

7. The arrangement as claimed in claim 2, wherein the at least one rib feature has a rib height which is approximately 10% of the height of the flow-passage.

* * * * *